US008421701B2

(12) United States Patent
Mailandt

(10) Patent No.: US 8,421,701 B2
(45) Date of Patent: Apr. 16, 2013

(54) OMNIDIRECTIONAL ANTENNA RADIATION ELEMENT

(75) Inventor: Peter Mailandt, Dallas, TX (US)

(73) Assignee: dcSpectra, Inc., Lewisville, TX (US)

( * ) Notice: Subject to any disclaimer, the term of this patent is extended or adjusted under 35 U.S.C. 154(b) by 427 days.

(21) Appl. No.: 12/799,227

(22) Filed: Apr. 21, 2010

(65) Prior Publication Data

US 2010/0309082 A1 Dec. 9, 2010

Related U.S. Application Data

(60) Provisional application No. 61/268,089, filed on Jun. 9, 2009.

(51) Int. Cl.
*H01Q 9/16* (2006.01)

(52) U.S. Cl.
USPC ..... 343/793; 343/800

(58) Field of Classification Search ..... 343/790–793, 343/798–800
See application file for complete search history.

(56) References Cited

U.S. PATENT DOCUMENTS

| | | | | |
|---|---|---|---|---|
| 2,605,412 | A * | 7/1952 | Riblet | 343/792 |
| 3,871,000 | A * | 3/1975 | Tymann | 343/771 |
| 6,414,647 | B1 * | 7/2002 | Lee | 343/793 |
| 6,864,853 | B2 * | 3/2005 | Judd et al. | 343/844 |
| 7,053,851 | B1 * | 5/2006 | Bogdans et al. | 343/792 |
| 2010/0066625 | A1 * | 3/2010 | Kazanchian | 343/787 |

* cited by examiner

*Primary Examiner* — Don Le

(57) ABSTRACT

An antenna element for use in an antenna assembly is provided. The antenna element includes a cylindrical tube. The antenna element also includes a plurality of fingers, each finger having a first end that is connected to the cylindrical tube and a second end that is free. Each finger protrudes inward from a wall of the cylindrical tube. The free end of each finger has an aperture configured to allow the finger to be soldered to a pipe disposed through a generally circular opening. An antenna assembly having at least one antenna element is also provided.

20 Claims, 4 Drawing Sheets

OMNIDIRECTIONAL ANTENNA RADIATION ELEMENT

CROSS-REFERENCE TO RELATED APPLICATION(S) AND CLAIM OF PRIORITY

The present application is related to U.S. Provisional Patent No. 61/268,089, filed Jun. 9, 2009, entitled "OMNIDIRECTIONAL ANTENNA RADIATION ELEMENT". Provisional Patent No. 61/268,089 is assigned to the assignee of the present application and is hereby incorporated by reference into the present application as if fully set forth herein. The present application hereby claims priority under 35 U.S.C. §119(e) to U.S. Provisional Patent No. 61/268,089.

TECHNICAL FIELD OF THE INVENTION

The present application relates generally to dipole antennas and, more specifically, to an improved omnidirectional antenna radiation element for use in a dipole antenna.

BACKGROUND OF THE INVENTION

A basic dipole antenna is an antenna that can be made by a simple arrangement of wires, for the purpose of transmitting or receiving radio frequency energy. Dipole antennas, in their most basic form, are among the simplest antennas. However, dipole antennas have a multitude of practical uses, including deployment in cellular radio systems (e.g., subscriber units and base stations).

Performance of dipole antennas can be enhanced by combining two or more antenna elements. One type of antenna element is disclosed in U.S. Pat. No. 5,105,199 (the '199 patent) to Ukmar, titled "Method and Apparatus for Tube Element Bracket," which is incorporated herein by reference. A prior art antenna element, such as the antenna element described in the '199 patent, has four small openings in the cross sections of the element, making it difficult to pass feed lines or phasing harnesses from element to element during antenna assembly. Additionally, a prior art antenna element according to the '199 patent has only two soldering points to secure the element to the central metal rod, thus making the soldered connection less secure. These shortcomings may be unacceptable to an antenna manufacturer who builds his reputation of failure-proof products.

Accordingly, there is a need in the art for an improved omnidirectional antenna radiation element.

SUMMARY OF THE INVENTION

An antenna element for use in an antenna assembly is provided. The antenna element includes a cylindrical tube. The antenna element also includes a plurality of fingers, each finger having a first end that is connected to the cylindrical tube and a second end that is free. Each finger protrudes inward from a wall of the cylindrical tube. An antenna assembly having at least one antenna element is also provided.

A method for manufacturing an antenna element is provided. The method includes providing a cylindrical tube. The method also includes forming a plurality of fingers, each finger having a first end that is connected to the cylindrical tube and a second end that is free. Each finger protrudes inward from a wall of the cylindrical tube.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 1A through 3, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged wireless network.

Figure 1B:
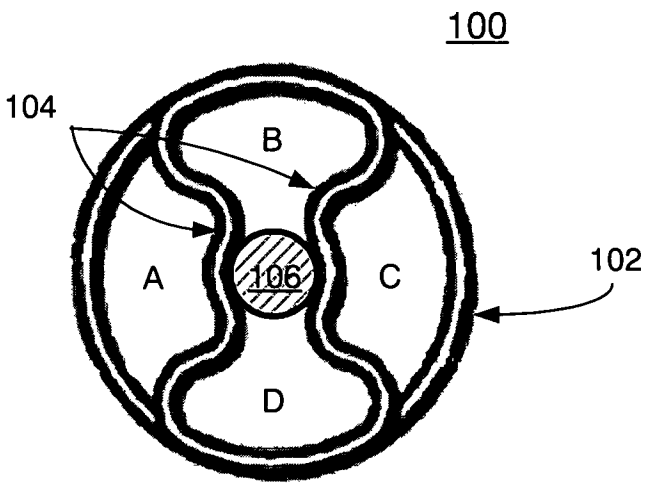
FIGS. 1A and 1B depict orthogonal and cross-sectional views of a conventional antenna radiation element, such as described in U.S. Pat. No. 5,105,199.
Figure 1A:
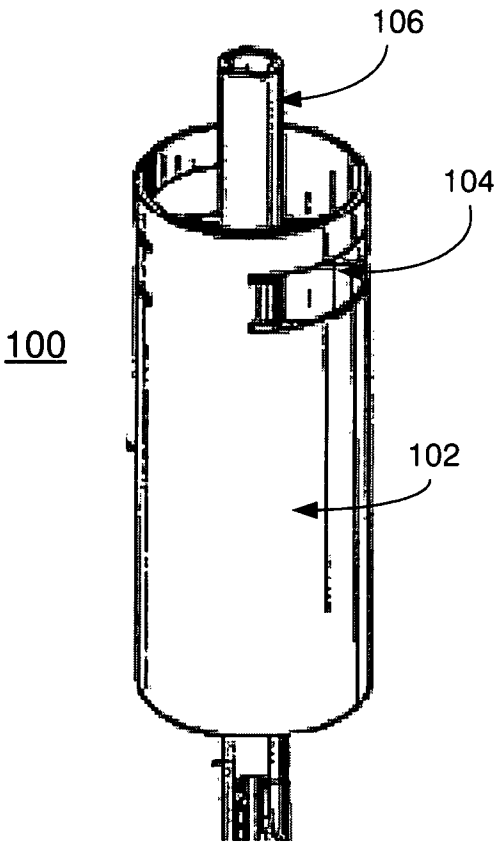

FIGS. 1A and 1B depict orthogonal and cross-sectional views of one example of a conventional antenna radiation element. The illustrations in FIGS. 1A and 1B are reproduced from FIGS. 3 and 5 of the '199 patent. Antenna element 100 includes a hollow, metal (often brass), cylindrical tube 102 with walls that are relatively thin in relation to the diameter of cylindrical tube 102. Conventional dimensions of cylindrical tube 102 are one and one-half inch outer diameter (1-½" O.D.) and a wall thickness of 0.032 inch. It is understood that these dimensions may differ from one design to another.

Near one end of cylindrical tube 102 are two brackets 104 disposed on opposite sides of cylindrical tube 102. The brackets 104 are formed by cutting slits along opposite sides of the circumference of cylindrical tube 102, then using a die to deform the resulting arcuate sections inward. The shape of brackets 104 can be seen in cross-sectional view in FIG. 1B. The configuration of brackets 104 as seen in FIG. 1B is sometimes referred to a "figure eight" or "hourglass" configuration, because of the shape formed by brackets 104.

The middle section of each bracket 104 is curved outward to fit closely against a metal pipe 106 that is inserted through the middle of antenna element 100. Each bracket 104 may include a small hole in the middle section to provide a point for soldering bracket 104 to metal pipe 106. The positions of brackets 104 and the walls of cylindrical tube 102 create four openings in the cross-section of antenna element 100. These openings are indicated by the reference letters A, B, C, and D.

During assembly of an antenna, one or more feed lines or phasing harnesses (not shown) may be passed through one or several of the openings A-D of antenna element 100. The feed lines serve to phase together multiple antenna elements, such as antenna element 100. These feed lines run on the outside of the metal pipe 106 and are soldered to the outside of pipe 106, but inside cylindrical tube 102. Typically, each feed line is a copper-clad cable approximately 0.144-0.25 inches in diameter. Due to the shape and small size of each opening A-D, it is not uncommon for all of the feed lines to have some difficulty passing through the selected opening. Likewise, because of the relative rigidity and close dimensions of brackets 104 in the hourglass configuration, it is not uncommon during antenna assembly for the multiple feed lines to have some difficulty passing between the two brackets 104. These shortcomings of the hourglass configuration of antenna element 100 are resolved by advantageous embodiments of the present disclosure.

Figure 2A:
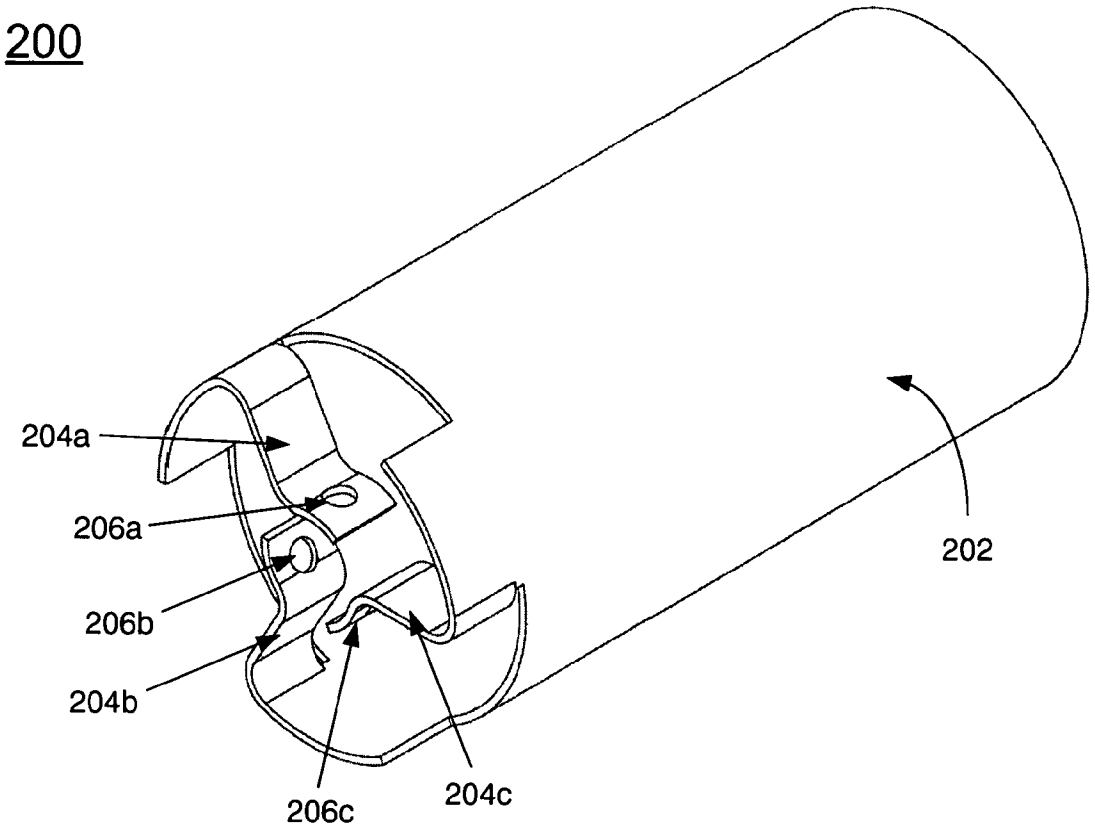
FIGS. 2A, 2B, and 2C illustrate orthogonal, cross-sectional, and longitudinal views, respectively, of an omnidirectional antenna radiation element according to one embodiment of the present disclosure.
Figure 2C:
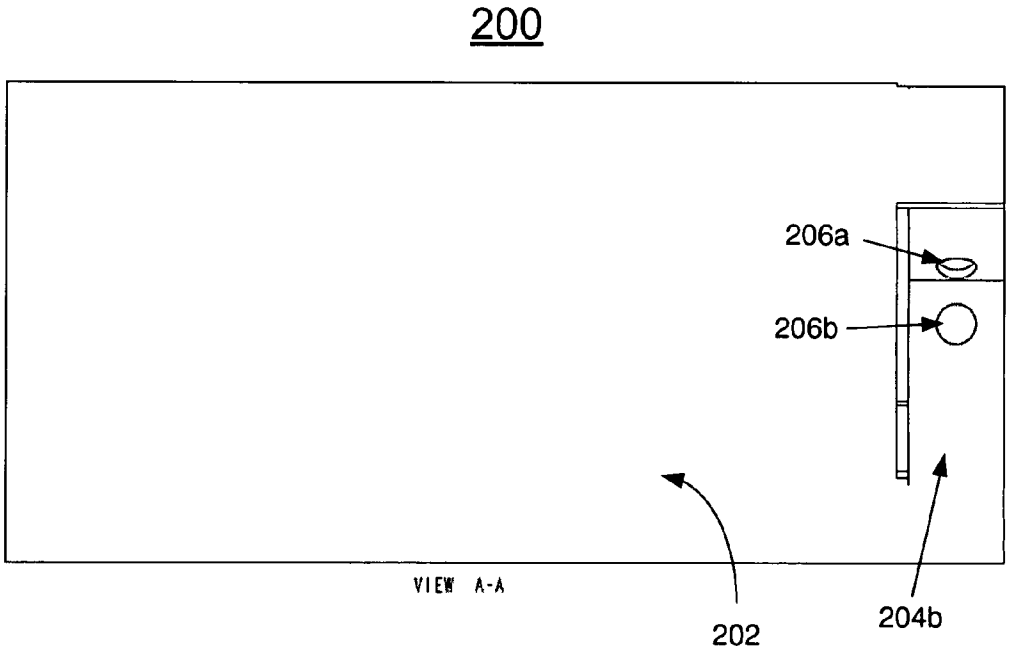
Figure 2B:
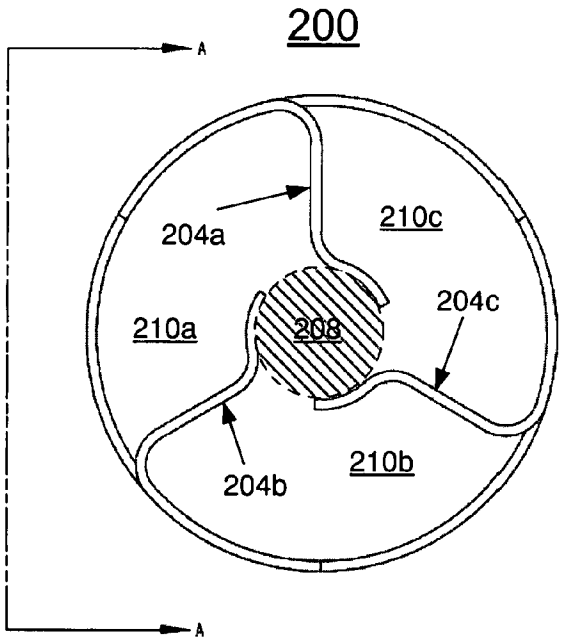

FIGS. 2A, 2B, and 2C illustrate orthogonal, cross-sectional, and longitudinal views, respectively, of an omnidirectional antenna radiation element according to one embodiment of the present disclosure. The uniqueness of antenna element 200 resides in the manner in which one end of antenna element 200 is formed and then attaches, by means of a soldering process, to a conductive center support, so as to provide mechanical stability and integrity of the antenna assembly. The embodiment of antenna element 200 shown in FIG. 2 is for illustration only. Other embodiments of antenna element 200 may be used without departing from the scope of this disclosure.

In the illustrated embodiment, antenna element 200 includes a hollow, metal cylindrical tube 202 with walls that are relatively thin in relation to the diameter of cylindrical tube 202. In certain embodiments, cylindrical tube 102 has an outer diameter of one and one-half to two inches (1-½"-2" O.D.) and a wall thickness of approximately 0.03 inch. In certain embodiments, cylindrical tube 202 is made from copper or brass. It is noted that these dimensions and materials are for example purposes only. Other dimensions and materials for cylindrical tube 202 are possible.

At one end of cylindrical tube 202 are three fingers 204 disposed around a circumference of cylindrical tube 202. Each finger has one "free" end and one end that is connected to cylindrical tube 202. By "free", it is meant that the end is unconnected or unattached to any other body or member at the time antenna element 200 is manufactured. During antenna assembly, the free end of each finger may be attached to a center pipe, as described below.

The fingers 204 are formed by cutting slits in cylindrical tube 202, both parallel and perpendicular to the axis of cylindrical tube 202. Then a die or other manufacturing tool is used to deform the resulting arcuate sections, so that they bend or protrude inward, as shown in FIGS. 2A and 2B. In advantageous embodiments, fingers 204 have approximately the same length and width, and are disposed one hundred twenty degrees (120°) of arc apart. Thus, fingers 204 are radially symmetrical about the axis of cylindrical tube 202. In certain embodiments, fingers 204 may be disposed near the end of cylindrical tube 202, or somewhere else along the length of cylindrical tube 202, rather than at the end of cylindrical tube 202.

Each finger 204 bends inward towards the center axis of antenna element 200. The free end of each finger 204 is curved. Together, the curved free ends form a generally circular opening. During antenna assembly, a metal center pipe 208 (shown in FIG. 2B) is inserted through the middle of antenna element 200 and through the circular opening. The radius of the curve of the free end of each finger 204 is chosen to allow the free end of each finger 204 to fit closely against the center pipe 208. Because the free end of each finger 204 is unattached, each finger 204 exhibits a certain amount of flexibility for movement in a plane perpendicular to the center axis of antenna element 200. This flexibility allows each finger 204 to easily yield its position slightly as center pipe 208 is inserted through the middle of antenna element 200, thus allowing easy insertion through antenna element 200. The flexibility of each finger 204 provides a desirable amount of dimensional tolerance during manufacture of antenna element 200, and provides desirable adjustability during antenna assembly. For example, if any finger 204 is slightly short or long, or if any finger 204 is bent too far inward, or not bent far enough inward, it may be adjusted by flexing the free end inward or outward as needed.

The flexibility of fingers 204 offers a significant improvement over the brackets 104 found in the hourglass configuration of antenna element 100 shown in FIG. 1. Each end of bracket 104 is connected to the wall of cylindrical tube 102. The lack of a free end in bracket 104 results in a much more rigid shape. The rigidity of brackets 104 results in lower dimensional tolerance during manufacture and less adjustability during antenna assembly. For example, if brackets 104 are too close together, the resulting space between them will be too small, making it difficult or impossible to insert metal pipe 106 through the space. On the other hand, if brackets 104 are too far apart, the metal pipe 106 may slip right through antenna element 100 without any friction to hold metal pipe 106 in place. This would make reliable soldering of antenna element 100 to metal pipe 106 difficult or impossible.

In the middle of the curved free end of each finger 204 is a small soldering hole 206. Soldering hole 206 is an aperture that passes completely through the thickness of finger 204. Soldering hole 206 provides a point for soldering each finger 204 to center pipe 208. Because each finger 204 has a soldering hole 206, there are a total of three soldering points for soldering antenna element 200 to center pipe 208. The use of three soldering points spaced evenly around the circumference of center pipe 208 allows for a very strong bond between antenna element 200 and center pipe 208. This is an improvement over the hourglass configuration of antenna element 100. Antenna element 100 includes only two soldering points, one in the middle of each bracket 104. The use of only two soldering points results in a weaker bond between antenna element 100 and metal pipe 106.

The use of three evenly-spaced soldering points in antenna element 200 offers another advantage over the hourglass configuration of antenna element 100. Like a three-legged stool, the three bonding points of antenna element 200 around center pipe 208 create a rigid, stable assembly with no degree of freedom. In other words, antenna element 200 may not wiggle, twist, or shift back and forth with respect to center pipe 208. On the other hand, antenna element 100 includes only two soldering points, located on opposite sides of metal pipe 106. Thus, antenna element 100 may be stable across one axis, but may be significantly prone to wiggle, toggle, or shift across another axis. Like a two-legged stool, antenna element 100 is not completely stable.

The positions of fingers 204 and the walls of cylindrical tube 202 create three openings 210 in the cross-section of antenna element 200. During assembly of an antenna, multiple feed lines and/or phasing harnesses (not shown) may be passed through the openings 210 of antenna element 200. In certain embodiments, each phasing harness is a cable approximately 0.142-0.25 inches in diameter.

Due to their number and shape, openings 210 present a significant improvement over the openings A-D of antenna element 100 shown in FIG. 1. Because there are only three openings instead of four, each opening 210 is larger than any of the openings A-D of antenna element 100. Additionally, the shape of each opening 210 has fewer concave curves and narrow dimensions than the openings A-D of antenna element 100. Thus, the phasing harnesses are less likely to get caught up in, or pinched by, openings 210. Also, because fingers 204 are radially symmetrical, each opening 210 has the same size and shape. Thus, multiple antenna elements 200 can be interconnected in a corporate feed arrangement by means of the phasing harnesses (with the phasing harnesses placed through one or all of openings 210) without regard to the rotational orientation of each antenna element 200. This approach provides a precise, phase-matched feeding of antenna elements 200 with the phasing harnesses accommodated inside cylindrical tube 202 but outside center pipe 208.

The radiation element of the present disclosure is typically used in multiple pairs as radiating elements of land mobile radio low- or high-gain antennas. The length of each element, such as antenna element 200, corresponds to approximately 0.5 times the wavelength of the electromagnetic wave the antenna is designed to transmit and/or receive. The number of antenna elements 200 that may be phased together determines the number of phasing harness cables that are passed through each element 200. The larger size and advantageous shape of the openings 210 in each element 200 may allow for a more complex phasing harness to be used in the antenna assembly. This, in turn, allows for more antenna elements 200 to be connected together, thus creating a higher gain antenna.

Figure 3:
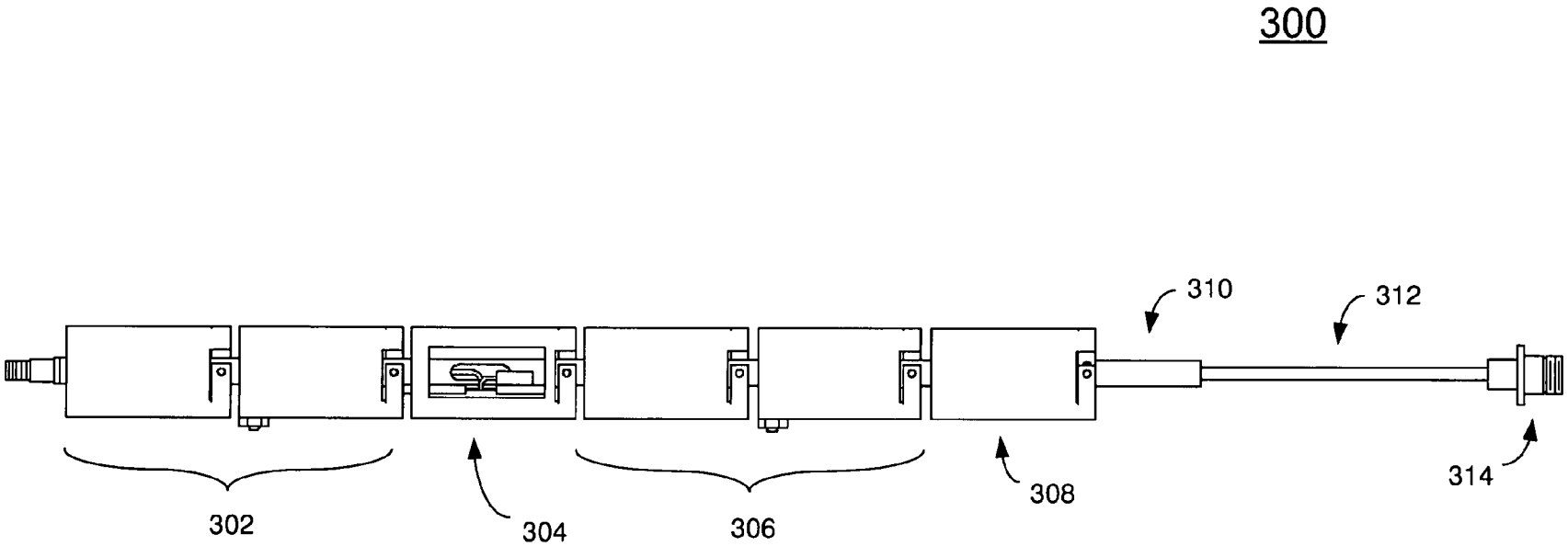
FIG. 3 illustrates an antenna assembly utilizing multiple omnidirectional antenna radiation elements according to one embodiment of the present disclosure.

FIG. 3 illustrates an antenna assembly utilizing multiple omnidirectional antenna radiation elements according to one embodiment of the present disclosure. The embodiment of the antenna assembly 300 shown in FIG. 3 is for illustration only. Other embodiments of the antenna assembly 300 may be used without departing from the scope of this disclosure.

Antenna assembly 300 includes two antenna elements 302, an antenna element 304 containing a signal splitter, two more antenna elements 306, a antenna element 308 known in the art as a "choke can", a metal pipe 310, a semi-rigid cable 312, and a connector 314. In certain embodiments, each of the antenna elements 302-308 may be equivalent or similar to the omnidirectional antenna radiation element 200 shown in FIG. 2. Similarly, metal pipe 310 may be equivalent or similar to center pipe 208.

Each of the antenna elements 302-308 is soldered to metal pipe 310. In certain embodiments, metal pipe 310 is composed of brass. In advantageous embodiments, metal pipe 310 includes a hollow core. The semi-rigid cable 312 runs from connector 314, through metal pipe 310, to the signal splitter in antenna element 304. In other embodiments, metal pipe 310 may be a rod having a solid core.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. For use in an antenna assembly, an antenna element comprising:

a cylindrical tube; and a plurality of fingers, each finger having a first end that is connected to the cylindrical tube and a second end that is free, wherein each finger is formed from a portion of the wall of the cylindrical tube that is deformed inward from surrounding portions of the wall of the cylindrical tube.

2. The antenna element as set forth in claim 1, wherein the free end of each finger is curved, and the curved free ends of every finger together form a generally circular opening.

3. The antenna element as set forth in claim 2, wherein the free end of each finger has an aperture configured to allow the finger to be soldered to a pipe disposed through the generally circular opening.

4. The antenna element as set forth in claim 1, wherein the fingers are radially symmetrical about an axis through a center of the antenna element.

5. The antenna element as set forth in claim 1, wherein the fingers are disposed at one end of the antenna element.

6. The antenna element as set forth in claim 1, wherein the fingers are disposed near one end of the antenna element.

7. The antenna element as set forth in claim 2, wherein each finger has sufficient flexibility to easily yield to a pipe passing through the generally circular opening.

8. An antenna assembly having at least one antenna element, the at least one antenna element comprising:

a cylindrical tube; and a plurality of fingers, each finger having a first end that is connected to the cylindrical tube and a second end that is free, wherein each finger is formed from a portion of the wall of the cylindrical tube that is deformed inward from surrounding portions of the wall of the cylindrical tube.

9. The antenna assembly as set forth in claim 8, wherein the free end of each finger is curved, and the curved free ends of every finger together form a generally circular opening.

10. The antenna assembly as set forth in claim 9, wherein the free end of each finger has an aperture configured to allow the finger to be soldered to a pipe disposed through the generally circular opening.

11. The antenna assembly as set forth in claim 8, wherein the fingers are radially symmetrical about an axis through a center of the antenna element.

12. The antenna assembly as set forth in claim 8, wherein the fingers are disposed at one end of the antenna element.

13. The antenna assembly as set forth in claim 8, wherein the fingers are disposed near one end of the antenna element.

14. The antenna assembly as set forth in claim 9, wherein each finger has sufficient flexibility to easily yield to a pipe passing through the generally circular opening.

15. A method for manufacturing an antenna element, the method comprising:

providing a cylindrical tube; and forming a plurality of fingers, each finger having a first end that is connected to the cylindrical tube and a second end that is free, wherein each finger is formed from a portion of the wall of the cylindrical tube that is deformed inward from surrounding portions of the wall of the cylindrical tube.

16. The method as set forth in claim 15, wherein the free end of each finger is curved, and the curved free ends of every finger together form a generally circular opening.

17. The method as set forth in claim 16, wherein the free end of each finger has an aperture configured to allow the finger to be soldered to a pipe disposed through the generally circular opening.

18. The method as set forth in claim 15, wherein the fingers are radially symmetrical about an axis through a center of the antenna element.

19. The method as set forth in claim 15, wherein the fingers are disposed at one end of the antenna element.

20. The method as set forth in claim 15, wherein the fingers are disposed near one end of the antenna element.

* * * * *